United States Patent [19]

Ogilvie

[11] 4,373,732

[45] Feb. 15, 1983

[54] TRAVEL GAME

[76] Inventor: Jim W. Ogilvie, 524 Wolfberry Rd., Richmond, Va. 23235

[21] Appl. No.: 53,622

[22] Filed: Jun. 29, 1979

[51] Int. Cl.[3] ..... A63F 3/00

[52] U.S. Cl. ..... 273/271; 273/269

[58] Field of Search ..... 35/27, 35 J, 70; 273/239, 269, 270, 271, 272

[56] References Cited

U.S. PATENT DOCUMENTS

| | | | |
|---|---|---|---|
| 2,628,838 | 2/1953 | Smalley | 35/77 UX |
| 2,967,714 | 1/1961 | Calabrese | 273/271 |
| 3,495,700 | 2/1970 | Chandos | 273/269 X |
| 3,987,558 | 10/1976 | Tsukamoto | 35/27 |
| 4,158,921 | 6/1979 | Stolpen | 35/70 |

FOREIGN PATENT DOCUMENTS

| | | | |
|---|---|---|---|
| 491948 | 4/1953 | Canada | 273/269 |

OTHER PUBLICATIONS

Travel Bingo Games, 1970 Regal Games Catalog, 3 pages

Spello Word Game, p. 130, Cleo Learning Aids Catalog, 1976.

*Primary Examiner*—Harland S. Skogquist

*Attorney, Agent, or Firm*—Griffin, Branigan & Butler

[57] ABSTRACT

A travel game includes polyhedron-shaped blocks (12) (usually cubed) having indicia (29) on all but one side (28*a–e*) thereof representing scenes commonly viewed along routes of travel. Also included on each of these sides (28*a–e*) is a number which represents the improbability (and therefore difficulty) of viewing the respective scene represented by the indicia thereon, with the easier-to-view scenes having lower numbers, and the harder-to-view scenes having higher numbers. The game also includes a compartmented retainer board (10) having compartments (14) for supporting the blocks (12) in rows (16) and columns (18) while prominently displaying one side of each of the blocks to game players. The game players can easily reorient the blocks (12) within their respective row and column positions to display other sides.

The game is normally played by two people each having a retainer board (10) with a plurality of blocks (12) thereon, with the sides (28*a–f*) of all blocks supported by each retainer board displaying an agreed upon number pattern. As scenes represented by the indicia are observed by the players, they reorient the blocks to display other sides (and other indicia) until a predetermined block orientation goal is achieved or a preset time or distance limit is reached.

7 Claims, 7 Drawing Figures

TRAVEL GAME

BACKGROUND OF THE INVENTION

This invention relates broadly to the art of games, and more particularly to travel-type games.

Several moderately-popular travel games exist to ease the boredom for travelers. For example, there is a game which employs a magnetic board having indicia imprinted thereon in rows and columns representative of scenes commonly viewed along highways, railroad tracks, or other travel routes. Magnetic tokens are placed onto the indicia as the scenes represented by the indicia are viewed by a player. This procedure is continued until a straight line of magnetic tokens, or some other predetermined pattern, has been completed. There are several difficulties with this, and similar, games which detract from their boredom-easing potential. For one thing, the indicia of a particular board is always presented in the same pattern; thus the same lines of tokens tend to form each time the game is played on a particular type of route—such as a limited-access highway. That is, one tends to see some of the items set forth on the board over and over while never seeing the other items.

Further, the above described game has limited value because some scenes depicted by the indicia are easy to find while others are extremely hard to find. The same difficult scenes normally form "stops" at the same board locations each time the game is played, which becomes somewhat monotonous.

Thus, it is an object of this invention to provide a "scene" tic-tac-toe-like travel game which employs indicia representative of scenes arranged in rows and columns, but which provides for the indicia to be periodically moved to new positions and to be easily replaced by different indicia entirely. It is a further object of this invention to provide such a game wherein the indicia can be easily chosen according to the difficulty of viewing the scenes they represent, whereby patterns of the game change often and the same "stops" do not develop again and again.

Still another difficulty with the above mentioned prior-art game is that it cannot conveniently be played fairly by adults against young children. That is, it is difficult to handicap adults in playing the above described game. Thus, it is an object of this invention to provide a game which allows adults to be easily handicapped so that the game can easily be fairly played between adults and children.

Yet another shortcoming of the above mentioned game is that it has little variety in that the basic rules of the game cannot conveniently be changed to play a variety of interesting games. Therefore it is an object of this invention to provide a travel game having a number of variations, all of which are fun and stimulating.

It is another object of this invention to provide a travel game which is uncomplicated in structure and relatively inexpensive to manufacture. Similarly, it is an object of this invention to provide a game which can be easily and quickly understood by both adults and children without the necessity of long written rules.

SUMMARY

According to principles of this invention, a travel game includes a compartmented retainer board for holding a plurality of polyhedron-shaped blocks in rows and columns so as to prominently display one side of each of the blocks. A plurality of the sides of each block have indicia thereon representative of scenes viewed along travel routes, with each side having such indicia also including one number from a consecutive sequence of numbers, representative of the difficulty of viewing the scene corresponding to the indicia. The sides of each block include all the numbers of the sequence.

In a basic method of playing the game, each player has a board with rows and columns of blocks being thereby supported to each have one side (and, therefore, an indicia representative of a particular scene) prominently displayed in an agreed upon number pattern. When the respective players view the scenes represented by the displayed indicia they are allowed to reorient the blocks having the appropriate displayed indicia to display a different side. The player achieving a particular block-orientation pattern relative to the other player's block orientation pattern wins the game.

BRIEF DESCRIPTION OF THE DRAWINGS

The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF PREFERRED EMBODIMENTS

Figure 1:
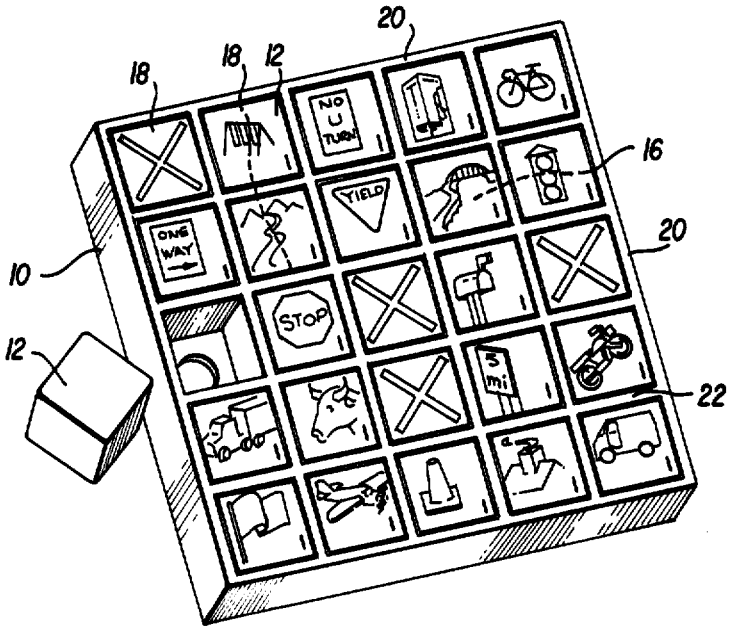
FIG. 1 is an isometric view of a game employing principles of this invention, including a retainer board and a plurality of blocks.
Figure 2:
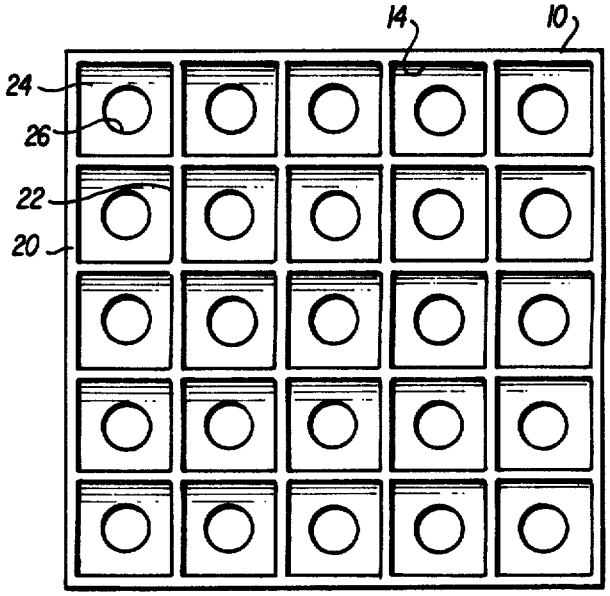
FIG. 2 is a top view of an empty retainer board of FIG. 1.
Figure 3:
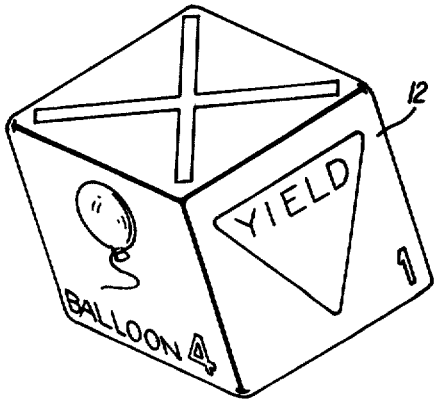
FIG. 3 is an isometric view of one block of FIG. 1.

With reference to FIGS. 1–4, the travel game of this invention includes a retainer board 10 and polyhedron-shaped blocks 12. In the preferred embodiment, the retainer board 10 has 25 equal-size, cube-shaped compartments 14 arranged in rows 16 and columns 18 and the blocks 12 are cube-shaped and sized to fit into the compartments 14. The five-walled compartments 14 are defined by side walls 20, a crossed grid 22 and a bottom 24. All of these members could be made of such materials as wood, plastic, "press board", and the like. The crossed grid 22 can merely be placed within the side walls 20, or it can be glued, or otherwise retained to the side walls 20 or the bottom 24. Further, all of these members could be formed or molded as one integral unit. It should be noted that the bottom 24 has openings 26 therein, one for each compartment 14, which allows a person to insert a finger from the bottom of the retainer board 10 to shove blocks 12 from the open tops of the particular compartments.

Figure 4:
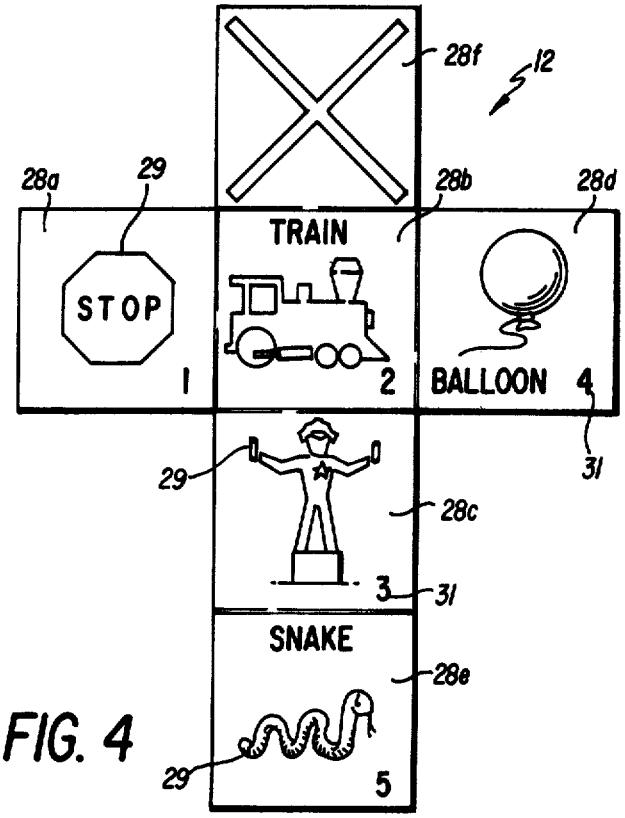
FIG. 4 is a folded-out view of the six sides of a block similar to that of FIG. 3.

The blocks 12, in the FIGS. 1–4 embodiment, are sized slightly smaller than the cube-shaped compartments 14 so that they easily fit into the compartments with one side of each block being prominently displayed. In this respect, each of the cubes has indicia 29 on five sides thereof representative of scenes that can be viewed from travel routes such as railroads, highways, and the like. In the preferred embodiment, none of the indicia represent the same scene, however, this is not essential and there could be duplicate indicia on different blocks. The sides of one block are depicted in FIG. 4 where one side 28*a* has indicia representative of a stop sign. Similarly, sides 28*b–e* have indicia 29 representative of a train, a policeman directing traffic, a balloon, and a snake thereon. The indicia is in the form of pictures, words, or a combination of pictures and words. A sixth side 28*f*, does not include an indicia 29 representative of a scene thereon. This side can be blank, or, as is depicted, can have an X or other non-scenic indicia thereon.

In addition to the scenic indicia 29, each scenic-indicia side of each block has a number 31 thereon, with the five sides of each block having consecutive numbers ranging from "one" to "five". Each of these numbers is indicative of the probability of seeing the scene represented by the indicia on the corresponding side with, for example, number "1" indicating a high probability of seeing the scene, number "5" indicating a low probability of seeing a scene, and the intermediate numbers indicating intermediate probabilities of seeing the scenes. As a further example, for the block of FIG. 4, stop signs occur rather frequently, and are easy to see, and for this reason side 28*a* has the number "1" thereon. Similarly, trains occur less frequently than stop signs, but more frequently than policemen directing traffic, and therefore side 28*b* has a "2" thereon. Side 28*c* has a "3" thereon which indicates that a policeman directing traffic is seen more often than a balloon, but less frequently than a train, and so on up to the number "5" for a snake which is the most difficult to see of the items depicted on that particular block. Thus, all of the blocks have indicia on the sides thereof representative of a spectrum of scenes ranging from a most difficult to find to a least difficult to find.

Describing next methods of using the travel game of this invention, some basic games played therewith are as follows:

Basic Game 1

Figure 4A:
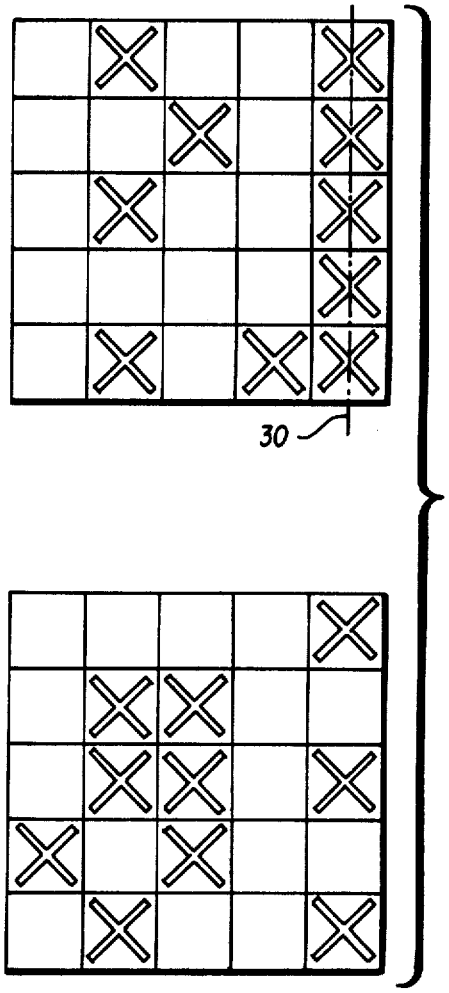
FIG. 4A is a schematic view of block patterns of two players playing the game of FIG. 1.

Two players each have a board 10 with 25 blocks 12 thereby supported so as to display their "1" sides, or the indicia representative of scenes easiest to see. The first player to view a scene represented by the indicia prominently displayed on one of his blocks can rotate that block to display the blank, or X'ed, side 28*f* thereof. This procedure is continued until one player has a line of blanks, or X's, as is shown by the imaginary line 30 in FIG. 4A.

There are a multitude of variations to this basic game as follows:

Variations to Basic Game 1

A. All players start with blocks prominently displaying indicia representative of more difficult-to-find scenes such as "2" scenes etc.

B. One player is handicapped by prominently displaying indicia for more difficult-to-find scenes on his board 10 than for the other player at the beginning of the game. For example, an adult sets his blocks 12 to prominently display number "4" sides while a child sets his blocks 12 to prominently display number "1" sides. This tends to equalize child vs. adult games and makes them more fun.

C. Each player orients the blocks 12 of the other player in the manner he desires at the beginning of the game.

D. All of the blocks 12 are "shuffled" together and are chosen and inserted into the respective boards at random at the beginning of the game.

E. Each player orients his blocks 12 as he desires at the beginning of the game, irrespective of the numbers.

Basic Game 2

This game is begun by both players having all their blocks 12 set to prominently display "1" sides. As the scenes indicated by the indicia are observed the associated blocks are rotated, sequentially, to display sides 2, 3, etc. Either a time limit, or a mileage limit is set on the game and when this limit is reached each player's prominently displayed numbers 31 are totaled. The player with the highest total wins. This game can also be played with only one board and the players taking consecutive turns. Again, there are many variations to this game, with the above variations to basic game 1 providing an indication thereof.

Basic Game 3

Each player starts with "1" sides showing and sequentially reorients his blocks to sides "1," "2," "3," etc. as scenes represented by the indicia on the respective sides are viewed. The first player to reach any number "5" side wins.

Basic Game 4

All blocks 12 are taken out of the retainer boards 10. Each player selects one block at a time. As scenes are observed by the players on their selected blocks, they insert the associated blocks into their retainer boards 10 with the sides having indicia thereon representative of the observed scenes being displayed. Once a player fills his retainer board 10, the game ends. Players then add up the numbers 31 prominently displayed on their boards with the highest total winning.

General Variations

Blocks can be interchanged between sets. Blocks can be taken out of the sets and chosen one at a time, like choosing up sides. There are many variations of games other than those listed above.

Figure 5:
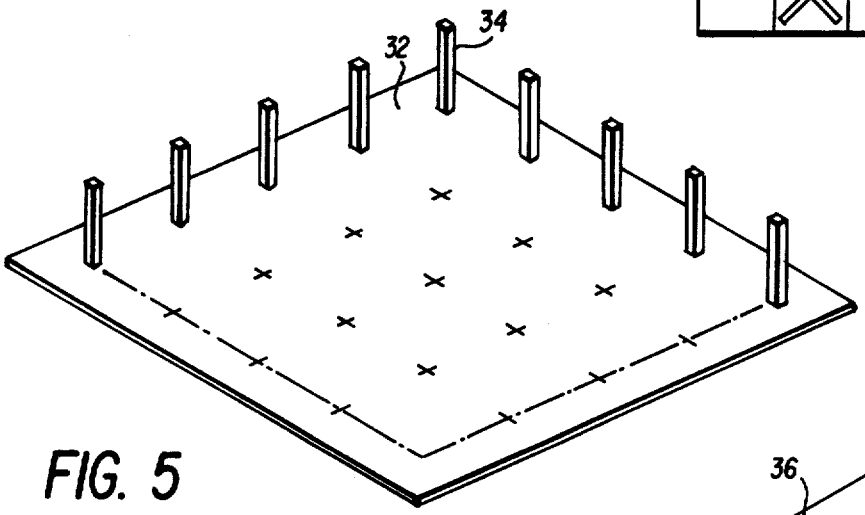
FIGS. 5 and 6 are respectively alternate embodiments of a board and block to form a game of the type as is depicted in FIG. 1.
Figure 6:
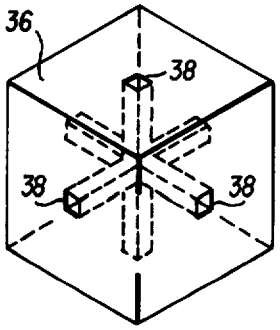

FIGS. 5 and 6 depict an alternate embodiment of this invention wherein a retainer board 32 has square cross-sectioned pegs 34 thereon onto which blocks 36 can be placed. In this respect, the blocks 36 have square cross-sectioned holes 38 at all sides for receiving the pegs 34. This alternate embodiment is played in the same manner as the FIGS. 1–4 embodiment.

It will be appreciated that the game described herein provides a beneficial opportunity for stimulating fun during travel for both adults and children. This game does not tend to follow the same pattern each time it is played as do most previous car games and it offers a variety of games that can be played therewith.

While the invention has been particularly shown and described with reference to preferred embodiments, it will be understood by those skilled in the art that various changes in form and detail may be made therein without departing from the spirit and scope of the invention. For example, the retainer board could be constructed quite differently for retaining the blocks thereon. In addition the blocks could have shapes other than cubes, in which case, the retainer board could have appropriately shaped compartments for receiving the differently shaped blocks and prominently displaying single sides thereof. Further, the blocks could be hollow, having an opening on the non-scenic side 28*f*.

The embodiments of the invention in which exclusive property or provilege are claimed are defined as follows:

1. A method of playing a game with polyhedron-shaped blocks having indicia on a plurality of sides of each of said blocks representing a scene commonly viewed along a route of travel, said method employing the following steps:

observing scenes along a route of travel corresponding to scenes represented by indicia on sides of said blocks;

arranging said blocks in rows and columns, with each of said arranged blocks displaying one side thereof prominently;

orienting said blocks in said rows and columns to have particular predetermined orientations upon players observing scenes represented by the indicia on the sides of said respective blocks;

whereby, said players orient said blocks until they achieve a pre-set orientation pattern or until a time or distance limit is reached.

2. A method as in claim 1 wherein there are numbers on sides of said blocks having indicia representing scenes commonly viewed along a route of travel to aid in recognizing and scoring block orientation patterns at the beginnings and ends of games.

3. A method of playing a game as in claim 2 wherein said numbers on the respective sides are representative of the probability of seeing the scenes represented by the indicia on the corresponding sides.

4. A method of playing a game as in claims 2 or 3 wherein at the beginning of a game all blocks are already in rows and columns oriented to prominently display sides having the same number thereon.

5. A method of playing a game as in claim 4 wherein one side of each of said blocks has no indicia representative of a scene that is viewed from a route of travel and this side is displayed upon a player viewing a scene represented by the indicia on the prominently displayed side.

6. A method of playing a game as in claim 4 wherein upon a player viewing a scene represented by a prominently displayed side the block of said scene is reoriented to a side having a consecutively higher number than the number on the side having the indicia representing the scene viewed.

7. A method of playing a game as in claim 2 wherein one side of each of said blocks has no indicia representative of a scene that is viewed from a route of travel and this side is displayed upon a player viewing a scene represented by the prominently displayed side.

* * * * *